US010711531B2

(12) United States Patent
Greci

(10) Patent No.: US 10,711,531 B2
(45) Date of Patent: Jul. 14, 2020

(54) DOUBLE WALL PIPE CONNECTION SYSTEM

(71) Applicant: Halliburton Energy Services, Inc., Houston, TX (US)

(72) Inventor: Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 172 days.

(21) Appl. No.: 15/745,458

(22) PCT Filed: Aug. 21, 2015

(86) PCT No.: PCT/US2015/046341
§ 371 (c)(1),
(2) Date: Jan. 17, 2018

(87) PCT Pub. No.: WO2017/034521
PCT Pub. Date: Mar. 2, 2017

(65) Prior Publication Data

US 2018/0209222 A1 Jul. 26, 2018

(51) Int. Cl.

| | |
|---|---|
| ***E21B 17/042*** | (2006.01) |
| ***E21B 17/18*** | (2006.01) |
| ***E21B 17/10*** | (2006.01) |
| ***E21B 43/08*** | (2006.01) |

(52) U.S. Cl.
CPC ..... *E21B 17/042* (2013.01); *E21B 17/1078* (2013.01); *E21B 17/18* (2013.01); *E21B 43/08* (2013.01); *E21B 43/084* (2013.01); *E21B 43/086* (2013.01); *E21B 43/088* (2013.01)

(58) Field of Classification Search
CPC .... E21B 17/042; E21B 17/1078; E21B 17/18; E21B 43/08; E21B 43/084; E21B 43/086; E21B 43/088
See application file for complete search history.

(56) References Cited

U.S. PATENT DOCUMENTS 3,942,824 A * 3/1976 Sable ..... E21B 17/1042 285/45
4,012,061 A * 3/1977 Olson ..... E21B 17/042 285/123.3
4,380,347 A * 4/1983 Sable ..... E21B 17/006 175/325.3

(Continued)

OTHER PUBLICATIONS

International Search Report and Written Opinion, PCT Patent Application No. PCT/US2015/046341, dated May 17, 2016; 15 pages.

*Primary Examiner* — Caroline N Butcher
(74) *Attorney, Agent, or Firm* — Baker Botts L.L.P.

(57) ABSTRACT

A double wall pipe connection system for a production tubing joint is disclosed. The double wall pipe connection system including a box adaptor having a first end and a second end, the first end coupled to a first base pipe and a first screen joint; a pin adaptor having a first end and a second end, the first end coupled to a second base pipe and a second screen joint and the second end of the box adaptor coupled to the second end of the pin adaptor to form a junction between the box adaptor and the pin adaptor; and a communication sleeve positioned across the junction between the box adaptor and the pin adaptor.

20 Claims, 11 Drawing Sheets

(56) References Cited

U.S. PATENT DOCUMENTS

| | | | | |
|---|---|---|---|---|
| 5,937,948 | A * | 8/1999 | Robbins, III | E21B 17/1078 166/241.6 |
| 6,405,800 | B1 | 6/2002 | Walker et al. | |
| 6,464,261 | B1 | 10/2002 | Dybevik et al. | |
| 8,511,380 | B2 | 8/2013 | Guignard et al. | |
| 2010/0308577 | A1* | 12/2010 | Chin | E21B 17/042 285/333 |
| 2011/0024105 | A1 | 2/2011 | Hammer et al. | |
| 2012/0205095 | A1* | 8/2012 | Yeh | E21B 17/02 166/242.6 |
| 2013/0206394 | A1 | 8/2013 | Garcia et al. | |
| 2014/0152458 | A1 | 6/2014 | Hiorth et al. | |
| 2015/0008002 | A1 | 1/2015 | Hughes et al. | |

* cited by examiner

DOUBLE WALL PIPE CONNECTION SYSTEM

RELATED APPLICATIONS

This application is a U.S. National Stage Application of International Application No. PCT/US2015/046341 filed Aug. 21, 2015, which designates the United States, and which is incorporated herein by reference in its entirety.

TECHNICAL FIELD

The present disclosure relates generally to well drilling and hydrocarbon recovery operations and, more particularly, to a double wall pipe connection system for pipe in a wellbore.

BACKGROUND

During recovery operations in a wellbore, different stimulation techniques may be performed downhole, including nitrogen circulation, acidizing, fracturing, or a combination of acidizing and fracturing. Acidizing and nitrogen circulation are designed to clean up residues and skin damage in the wellbore in order to improve the flow of hydrocarbons. Fracturing is designed to create fractures in the formation surrounding the wellbore to allow hydrocarbons to flow from a reservoir into the wellbore. To enable the use of these stimulation techniques, perforations, or holes, may be created in a downhole casing in the wellbore. The perforations allow acid and other fluids to flow from the wellbore into the surrounding formation. The perforations may also allow hydrocarbons to flow into the wellbore from fractures in the formation created during fracturing techniques.

Recovery operations may also include using one or more sections of screened production tubing joints including a base pipe surrounded by a screen joint. The screened production tubing joints may be placed in the wellbore opposite the fractures or perforations and may allow fluids to flow into the wellbore while blocking sand, rock, or other sediments from entering the wellbore.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

A double wall pipe connection system is disclosed. During subterranean operations, production tubing may include screen joints surrounding sections of base pipe to form a double wall pipe section. The double wall pipe sections are joined by coupling a box adaptor located on one double wall pipe section to a pin adaptor located on a another double wall pipe section. The junction between the box adaptor and the pin adaptor is covered by a screened communication sleeve to minimize the unscreened space along the length of production tubing. During the mating process when the box adaptor and the pin adaptor are coupled together, a torque transmission tool is used to transmit torque from the box adaptor to the pin adaptor without the need for handling room on the screen joints. The torque transmission tool also serves to protect the communication sleeve during the mating process and prevent damage to the screen material on the communication sleeve. A double wall pipe connection system maximizes the screen coverage in the production tubing and provides nearly uninterrupted screen coverage in a production zone of the wellbore. Additionally, the system provides a fluid flow path across the junction of the double wall pipe. Accordingly, a double wall pipe connection system may be formed in accordance with the teachings of the present disclosure and may have different designs, configurations, and/or parameters according to a particular application. Embodiments of the present disclosure and its advantages are best understood by referring to FIGS. 1 through 6D, where like numbers are used to indicate like and corresponding parts.

Figure 1:
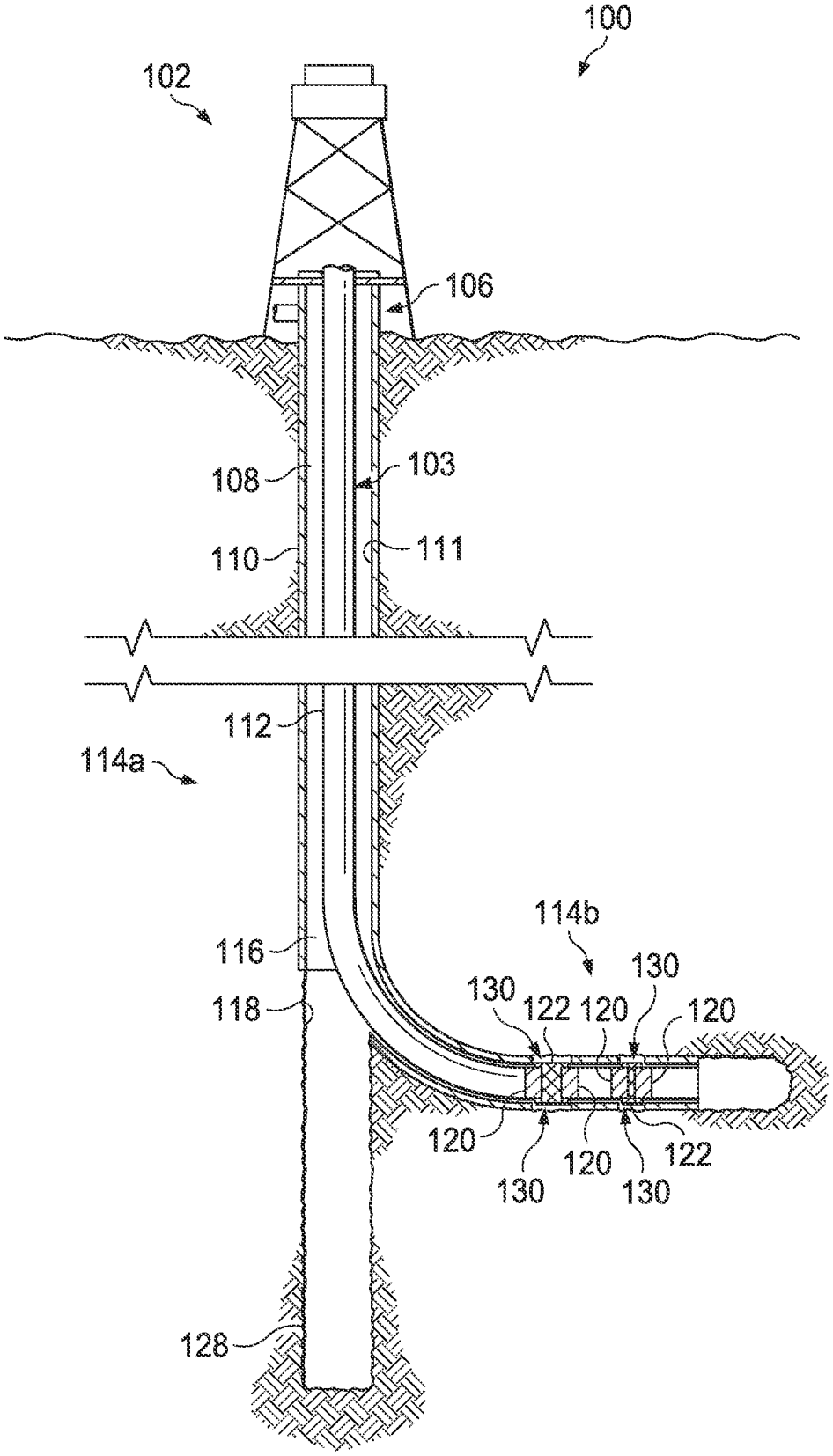
FIG. 1 illustrates an elevation view of an example embodiment of a subterranean operations system.

FIG. 1 illustrates an elevation view of an example embodiment of a subterranean operations system. In the illustrated embodiment, subterranean operations system 100 may be associated with land-based subterranean operations. However, subterranean operations tools incorporating teachings of the present disclosure may be satisfactorily used with subterranean operations equipment located on offshore platforms, drill ships, semi-submersibles, and drilling barges.

Subterranean operations system 100 includes wellbore 114 that is defined in part by casing string 110 extending from well surface 106 to a selected downhole location. Portions of wellbore 114 that do not include casing string 110 may be described as open hole. Uphole may be used to refer to a portion of wellbore 114 that is closer to well surface 106 and downhole may be used to refer to a portion of wellbore 114 that is further from well surface 106.

Various types of fluid, such as oil, water, or gas, may be pumped from downhole to well surface 106 through wellbore 114. The fluids may be directed to flow through production tubing 103 or through annulus 108. In open hole embodiments, annulus 108 is defined in part by outside diameter 112 of production tubing 103 and inside diameter 118 of wellbore 114. In embodiments using casing string 110, annulus 108 is defined by outside diameter 112 of production tubing 103 and inside diameter 111 of casing string 110. As shown in FIG. 1, wellbore 114 may be substantially vertical (e.g., substantially perpendicular to the surface), substantially horizontal (e.g., substantially parallel to the surface), or at an angle between vertical and horizontal.

Some portions of production tubing 103 include one or more screen joints 120 surrounding base pipes (not expressly shown). The base pipe through which fluids and/or gases flow from the reservoir surrounding the wellbore to well surface 106. As illustrated in FIG. 1, screen joints 120 may be aligned with one or more perforations 130 in casing string 110. In other examples, screen joints 120 may be aligned with a fracture in a rock formation surrounding wellbore 114. Screen joints 120 allow fluids to enter production tubing 103 while blocking sand or other particulate material. Screen joints 120 may be formed of a mesh screen material or a slotted liner. The gauge of the mesh forming the screen or the size (e.g., length and/or width) of the slots in the slotted liner may be designed based on the size of the particles in the wellbore, the strength and durability requirements of the environment in the wellbore, and/or any other suitable design characteristic.

Screen joints 120 may be coupled to base pipes via any suitable coupling mechanism including welding, shrink rings, an interference fit, or a press fit. The combination of screen joint 120 and base pipes form a double wall pipe where fluids flow through the annulus formed between screen joint 120 and the base pipe. Multiple screen joints 120 and base pipe sections may be connected with a double wall pipe connection system that connects the sections of production tubing 103 without disrupting the flow of fluids through the annulus between screen joint 120 the base pipe.

The double wall pipe connection system includes adaptors that connect two sections of production tubing 103, as described in further detail with respect to FIGS. 2 through 6D. The double wall pipe connection system further includes communication sleeve 122 that bridges the adaptors to provide an annulus between the adaptors and communication sleeve 122 such that fluid flows between the adaptors and communication sleeve 122. Communication sleeve 122 may be formed of a screened material, similar to screen joints 120, that allows fluid to flow into the annulus between communication sleeve 122 and the adaptors. Therefore, a double wall pipe connection system designed according to the present disclosure maximizes the screen coverage and provides a substantially uninterrupted screen area in an area of wellbore 114.

Figure 2A:
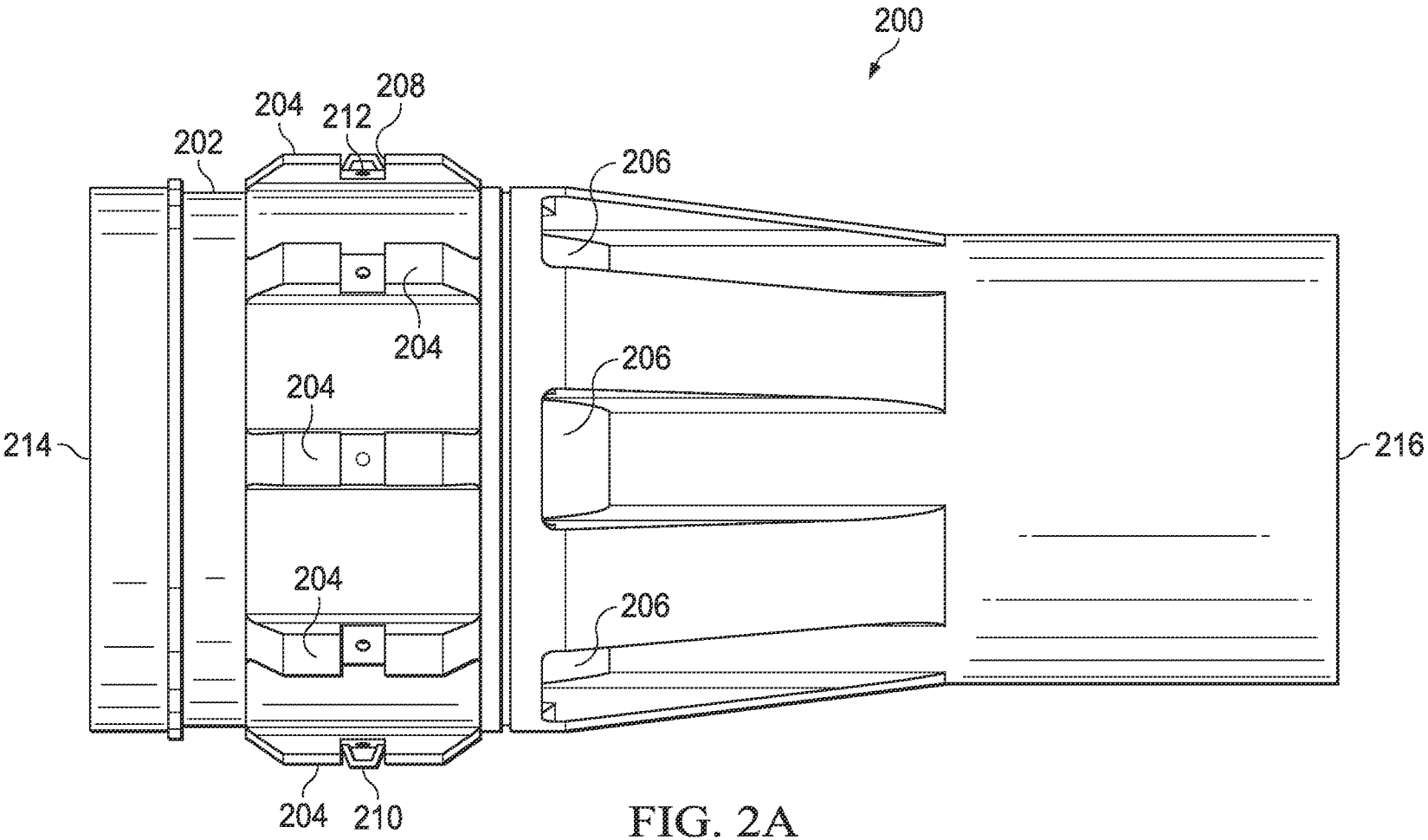
FIG. 2A illustrates a side view of a box adaptor for use in a double wall pipe connection system.
Figure 2B:
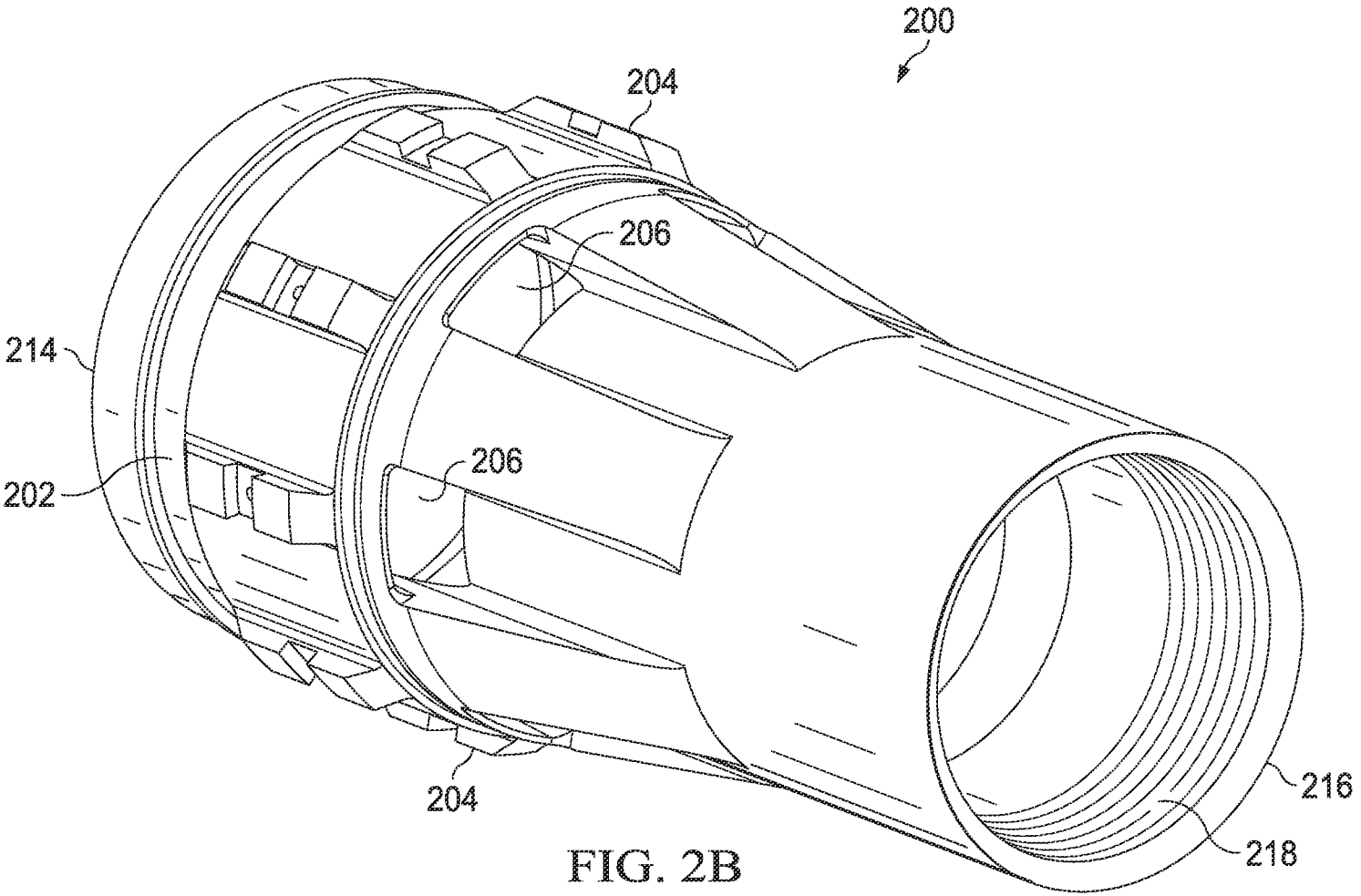
FIG. 2B illustrates a perspective view of the box adaptor of FIG. 2A for use in a double wall pipe connection system.

FIG. 2A illustrates a side view of a box adaptor for use in a double wall pipe connection system and FIG. 2B illustrates a perspective view of the box adaptor of FIG. 2A. Box adaptor 200 includes screen table shoulder 202, centralizer fins 204, fluid flow ports 206, indentions 208, caps 210, and threaded holes 212. Box adaptor 200 may be made of any suitable material that can withstand the conditions in a wellbore, such as stainless steel. In some examples, box adaptor 200 may be a similar material as the material forming the base pipe. The diameter of box adaptor 200 may be approximately equal to the diameter of the screen adjacent to box adaptor 200 when box adaptor 200 is attached to a base pipe. For example, the inner surface of end 214 of box adaptor 200 may include internal threads 218 that engage with threads on the outer surface of an end of the base pipe. The inner diameter of end 214 of box adaptor 200 may be larger than the outer diameter of the base pipe to which box adaptor 200 is connected. The difference in the diameters of box adaptor 200 and the base pipe creates an annulus between the outer diameter of the base pipe and the inner diameter of box adaptor 200. In examples where a flush joint connection is used, the outer diameter of end 216 may be approximately equal to the outer diameter of the corresponding base pipe.

Screen table shoulder 202 is an indentation on box adaptor 200 where the screen table may be inserted to support the weight of box adaptor 200 and the base pipe coupled to box adaptor 200 while box adaptor 200 is being mated to a pin adaptor. The mating process is described in further detail in the description of FIGS. 6A-6D. The depth of the indentation of screen table shoulder 202 may be any suitable depth that allows the screen table to engage with box adaptor 200 and securely hold box adaptor 200 during the mating process. For example, the depth of screen table shoulder 200 may be related to the weight of the production tubing suspended from box adaptor 200 during the mating process, the strength of the material of which box adaptor 200 is made, and/or the bearing area of screen table shoulder 200.

Centralizer fins 204 may be protrusions that are spaced around the outer surface of box adaptor 200. Centralizer fins 204 may be formed of the same material as box adaptor 200. There may be any number of centralizer fins 204 on box adaptor 200. In some examples, box adaptor 200 may include more than three centralizer fins such that one of centralizer fins 204 is in contact with the wall of the wellbore, rather than the main body of box adaptor 200, in order to not impede fluid flow around the outer perimeter of box adaptor 200. Centralizer fin 204 may additionally support box adaptor 200 in the wellbore and may be used to couple a torque transmission tool to box adaptor 200 during the mating process when box adaptor 200 is coupled to a pin adaptor, as described in further detail with respect to FIGS. 6A-6D.

The outer diameter of box adaptor 200 may taper from end 214 to end 216. Specifically, the tapering may occur between fluid flow ports 206 and end 216. The diameter at end 214 may be approximately equal to the diameter of a screen joint located adjacent to end 214 and the diameter at end 216 may be approximately equal to the diameter of a screen located in the double wall pipe. The taper of box adaptor 200 may provide a path for fluid to flow through fluid flow ports 206 and over end 216 without impeding or redirecting the flow of fluid over box adaptor 200.

Fluid flow ports 206 may be located around the outer diameter of box adaptor 200 to allow fluid to flow from the inside of box adaptor 200 to the outside of box adaptor 200. As described in further detail with respect to FIG. 4, fluid flow ports 206 may allow fluid to flow from the annulus between a screen joint and the base pipe, through fluid flow ports 206, and across the outer surface of a tapered region of box adaptor 200. Fluid flow ports 206 allow sections of base pipe and screen joints to be coupled without impeding the flow of fluid around the base pipe.

Indentions 208 may be disposed in at least a portion of centralizer fins 204. Indentions 208 may be used to secure a control line along the production tubing formed by the base pipes and screen joints coupled together by box adaptor 200 and a pin adaptor. The control line may be inserted between centralizer fins 204 and cap 210 may be placed over the control line to secure the control line under cap 210. Cap 210 may be made of any suitable material that can withstand the conditions in the wellbore, including plastic and stainless steel.

Cap 210 may be attached to centralizer fin 204 via threaded hole 212. Threaded hole 212 may be formed in centralizer fin 204 during the manufacturing process to provide a connection point for cap 210. Cap 210 may include threads to engage with threaded hole 212. When cap 210 is coupled to threaded hole 212, a control wire may be secured between two centralizer fins 204. The use of indentation 208 and cap 210 may allow the control line to be routed across the joint between box adaptor 200 and a pin adaptor. Box adaptor 200 may include indentions 208 and threaded holes 212 on each centralizer fin and include cap 210 in indention 208 near which a control line is routed.

The inner surface of end 216 of box adaptor 200 may include threads 218 that may be used to couple box adaptor 200 with a pin adaptor, as described in further detail in the discussion of FIGS. 6A-6D. The size of the inner diameter of end 216 of box adaptor 200 may have a size corresponding to the outer diameter of an end of the pin adaptor, such that the threads on box adaptor 200 engage with the threads on the pin adaptor.

Figure 3A:
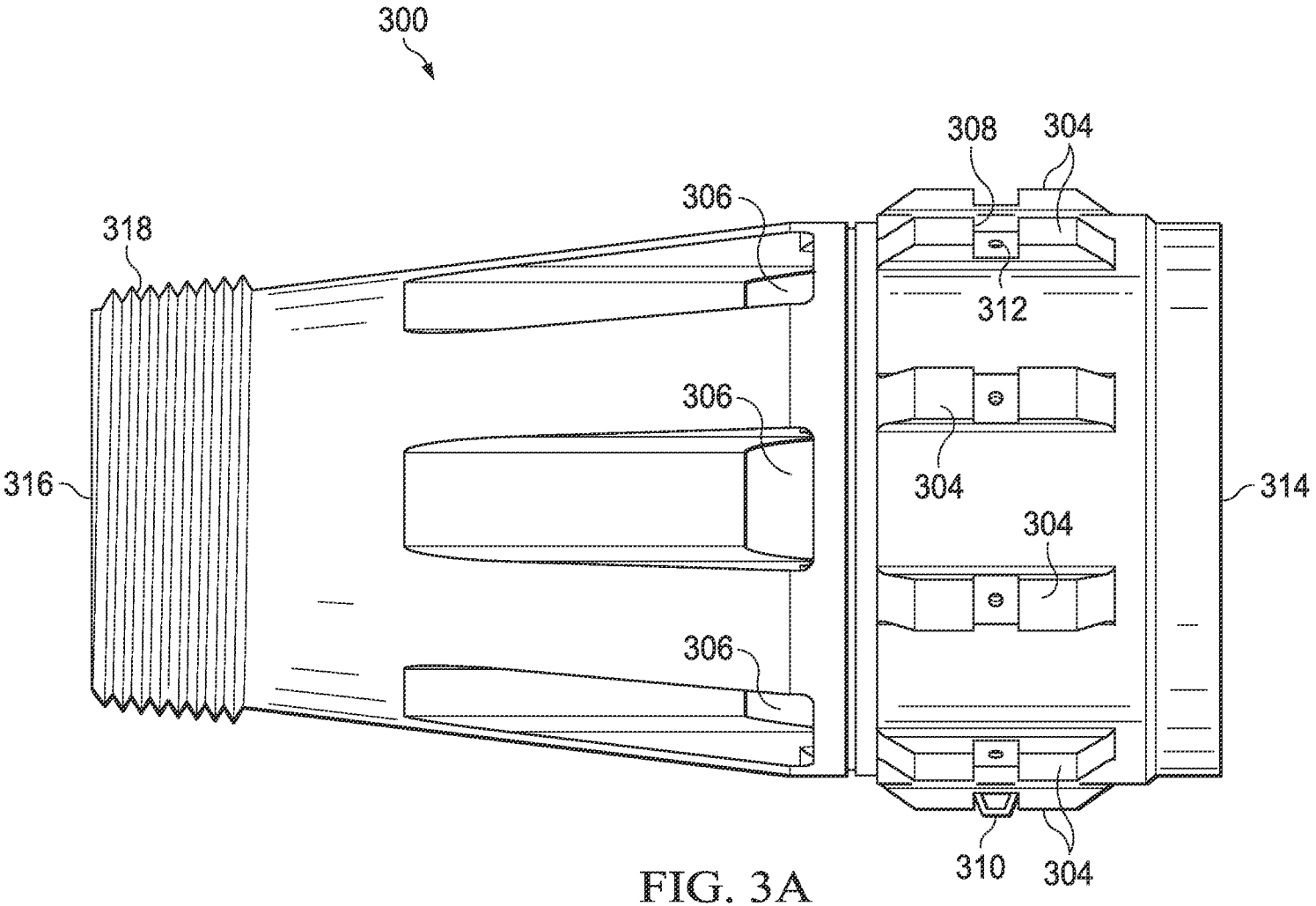
FIG. 3A illustrates a side view of a pin adaptor for use in a double wall pipe connection system.
Figure 3B:
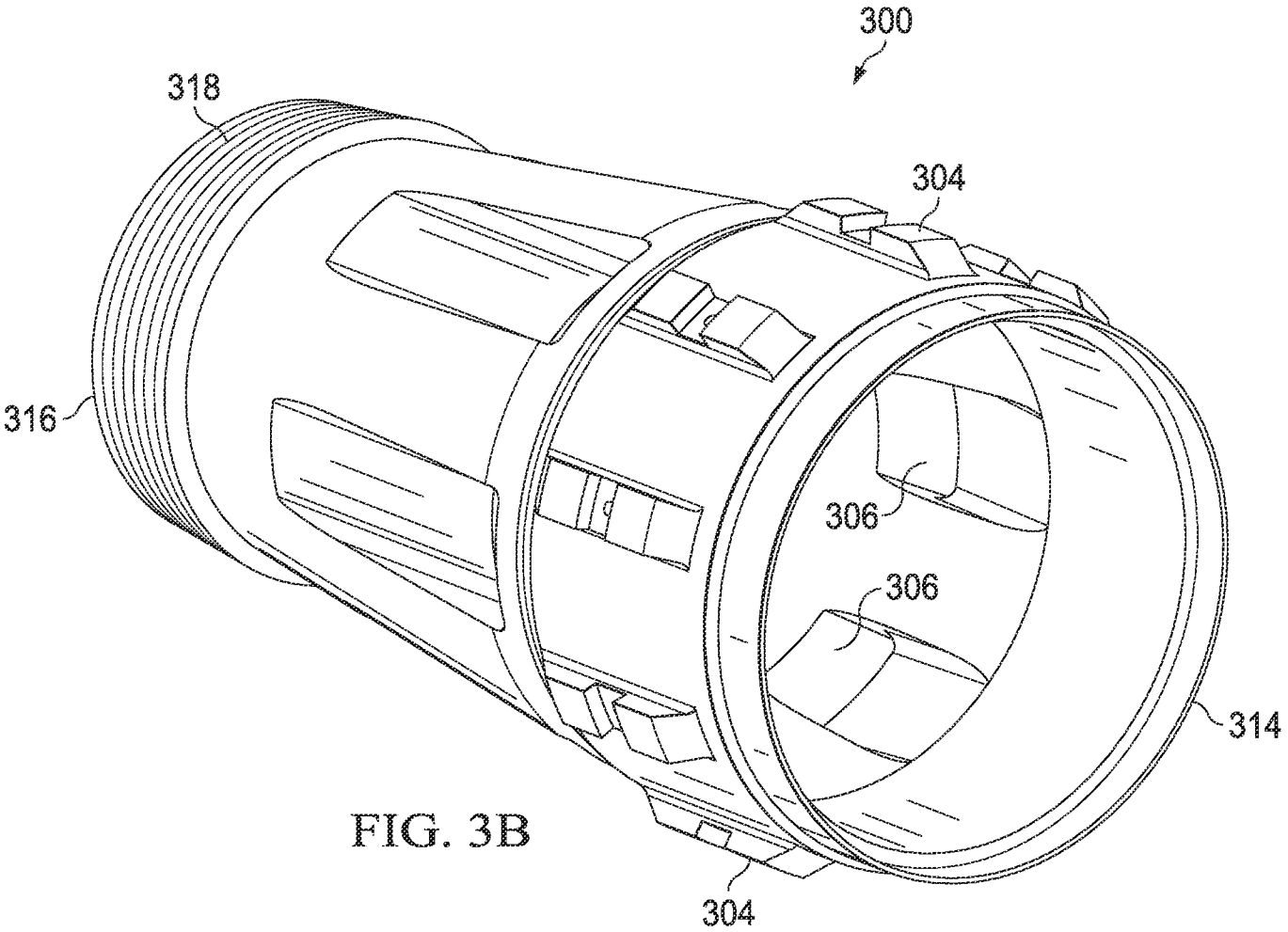
FIG. 3B illustrates a perspective view of the pin adaptor of FIG. 3A for use in a double wall pipe connection system.

FIG. 3A illustrates a side view of a pin adaptor for use in a double wall pipe connection system and FIG. 3B illustrates a perspective view of the pin adaptor of FIG. 3A. Pin adaptor 300 includes centralizer fins 304, fluid flow ports 306, indentions 308, caps 310, and threaded holes 312. Pin adaptor 300 may be made of any suitable material that can withstand the conditions in a wellbore, such as stainless steel. In some examples, pin adaptor 300 may be made of a similar material as the material forming the base pipe. The diameter of pin adaptor 300 may be approximately equal to the diameter of the screen adjacent to pin adaptor 300 when pin adaptor 300 is attached to a base pipe. For example, the inner diameter of end 314 of pin adaptor 300 may include internal threads (not expressly shown) that engage with threads on the outer perimeter of the base pipe. The inner diameter of end 314 of pin adaptor 300 may be larger than the outer diameter of the base pipe to which pin adaptor 300 is connected. The difference in the diameters of pin adaptor 300 and the base pipe creates an annulus between the outer diameter of the base pipe and the inner diameter of pin adaptor 300. In examples where a flush joint connection is used, the outer diameter of end 316 may be approximately equal to the outer diameter of the corresponding base pipe.

Centralizer fins 304 may be protrusions spaced around the outer surface of pin adaptor 300 and may be similar to centralizer fins 204 illustrated in FIG. 2. Centralizer fins 304 may be formed of the same material as pin adaptor 300. There may be any number of centralizer fins 304 on pin adaptor 300, however, the number of centralizer fins 304 included on pin adaptor 300 may be such that the main body of pin adaptor 300 does not contact the wall of the wellbore in any configuration. Instead, one or more centralizer fins 304 is in contact with the wall of the wellbore rather than the main body of pin adaptor 300, in order to not impede fluid flow around the outer perimeter of pin adaptor 300. Centralizer fin 304 may additionally support pin adaptor 300 in the wellbore and may be used to as an attachment point for tooling used when pin adaptor 300 is coupled to a box adaptor, as described in further detail with respect to FIGS. 6A-6D.

The outer diameter of pin adaptor 300 may taper from end 314 to end 316. Specifically, the tapering may occur between fluid flow ports 306 and end 306. The diameter at end 314 may be approximately equal to the diameter of a screen joint located adjacent to end 314 and the diameter at end 316 may be approximately equal to the diameter of a screen located in the double wall pipe. The taper of pin adaptor 300 may provide path for fluid to flow through fluid flow ports 306 and over end 316 without impeding or redirecting the flow of fluid over pin adaptor 300.

Fluid flow ports 306 may be located around the outer diameter of pin adaptor 300 to allow fluid to flow from the inside of pin adaptor 300 to the outside of pin adaptor 300. As described in further detail with respect to FIG. 4, fluid flow ports 306 may allow fluid to flow across the outer surface of pin adaptor 300, through fluid flow ports 306, to the annulus between a screen joint and the base pipe. Fluid flow ports 306 allow sections of base pipe and screen joints to be coupled without impeding the flow of fluid around the base pipe.

Indentions 308 may be disposed in at least a portion of centralizer fins 304 similar to indentions 208 in FIG. 2. Indentions 308 may be used to secure a control line along the production tubing. The control line may be inserted between centralizer fins 304 and cap 310 may be placed over the control line to secure the control line under cap 310. Cap 310 may be similar to cap 210 in FIG. 2 and may be made of any suitable material that can withstand the conditions in the wellbore, including plastic and stainless steel.

Cap 310 may be attached to centralizer fin 304 via threaded hole 312 which may be formed in centralizer fin 304 during the manufacturing process to provide a connection point for cap 310. Cap 310 may include threads to engage with threaded hole 312. When cap 310 is coupled to threaded hole 312, a control wire may be secured between two centralizer fins 304. Pin adaptor 300 may include indentions 308 and threaded holes 312 on each centralizer fin and include cap 310 in indention 308 near which a control line is routed.

The outer surface of end 316 of pin adaptor 300 may include threads 318 that may be used to couple pin adaptor 300 with a box adaptor, as described in further detail in the discussion of FIGS. 6A-6D. The size of the outer diameter of end 316 of pin adaptor 300 may have a size corresponding to the inner diameter of an end of the box adaptor, such that the threads on pin adaptor 300 engage with the threads on the inner surface of the box adaptor.

Figure 4:
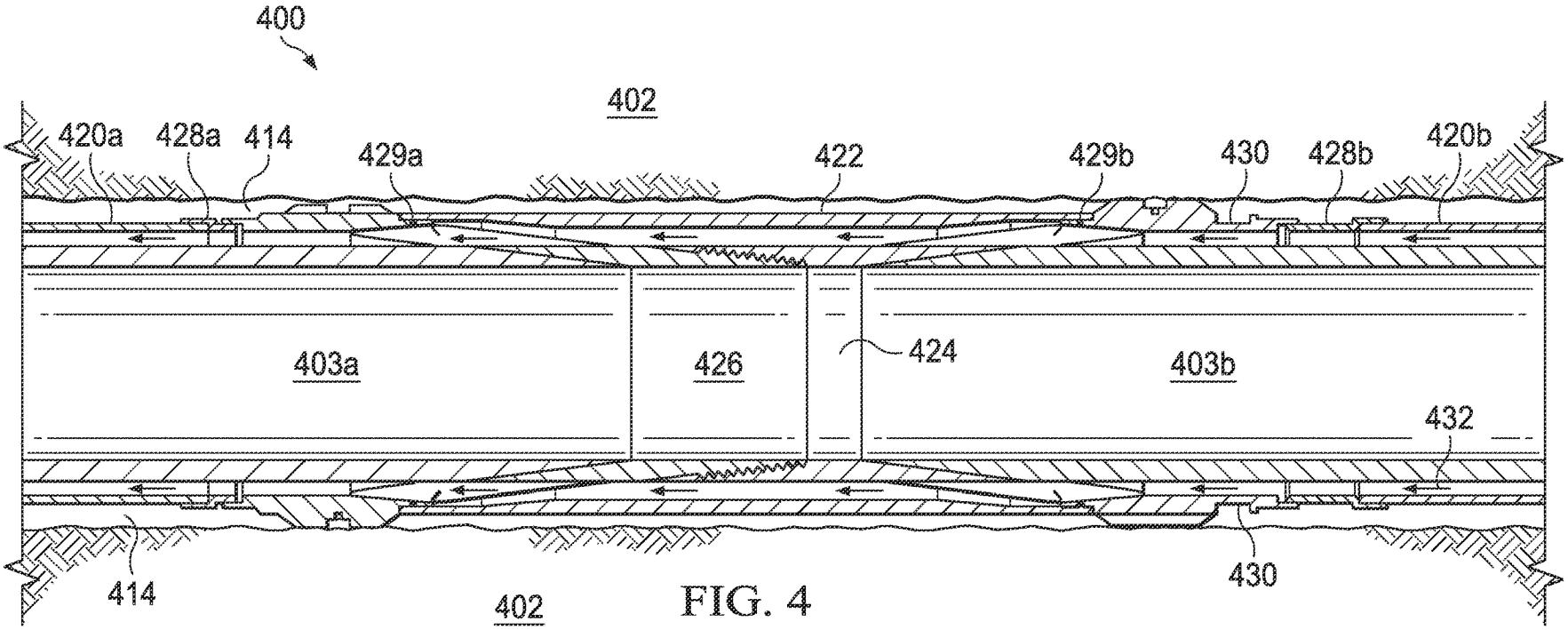
FIG. 4 illustrates a cross-sectional view of a wellbore including screen joints, production tubing, and a double wall pipe connection system.

FIG. 4 illustrates a cross-sectional view of a wellbore including screen joints, production tubing, and a double wall pipe connection system. Double wall pipe connection system 400 may be in wellbore 414 formed in formation 402. The double wall pipe connection system may include communication sleeve 422, box adaptor 424, and pin adaptor 426. As described in further detail below, box adaptor 424 may couple to pin adaptor 426 to join two sections of base pipe 403. Communication sleeve 422 may cover the joint between box adaptor 424 and pin adaptor 426 to provide a fluid flow path between communication sleeve 422 and adaptors 424 and 426.

Base pipes 403 may include screen joints 420 surrounding the outer diameter of base pipes 403. Base pipe 403*a* and screen joint 420*a* form a first section of a double wall pipe and base pipe 403*b* and screen joint 420*b* form a second section of a double wall pipe. In FIG. 4, screen joints 420 are shown coupled to base pipes 403 via shrink rings 428. However, screen joints 420 may be coupled to base pipes 403 via any suitable coupling method including welding, an interference fit, and a press fit. Screen joint 420 may be terminated before the end of base pipe 403. The section of base pipe 403 extending past the termination of screen joint 420 may be used to couple with either box adaptor 424 or pin adaptor 426.

Base pipe 403*a* may have a male connector, which may be inserted into the inner surface of pin adaptor 426. In some examples, base pipe 403*a* may include threads and may couple to pin adaptor 426 via threads located in the inner surface of pin adaptor 426. In other examples, base pipe 403*a* may be coupled to pin adaptor 426 via welding, an interference fit, or a press fit.

Base pipe 403*b* may also have a male connector, which may be inserted into the inner surface of box adaptor 424. Base pipe 403*b* may include threads and may couple to box adaptor 424 via threads located in the inner surface of box adaptor 424 or via welding, an interference fit, or a press fit. During manufacturing, base pipe 403 may be coupled to a box adaptor 424 on one end and a pin adaptor 426 on the other end. The base pipe 403 may then be coupled to another base pipe 403 by coupling a box adaptor 424 to a pin adaptor 426, as shown in FIG. 4. The coupling process is described in more detail in the discussion of FIGS. 6A-6D.

Communication sleeve 422 may be placed over box adaptor 424 and pin adaptor 426 where the outer diameters of box adaptor 424 and pin adaptor 426 taper. Communication sleeve 422 may provide an annulus between communication sleeve 422 and the outer surfaces of the tapered regions of adaptors 424 and 426 where fluid flows out of fluid flow ports on box adaptor 424, across the outer perimeter of adaptors 424 and 426 and into the fluid flow ports on pin adaptor 426. The fluid may flow along fluid flow path 432.

Sealing elements 429*a* and 429*b* may be located at one or both axial ends of communication sleeve 422 to respectively seal the junction between communication sleeve 422 and box adaptor 424 and pin adaptor 426. Sealing elements 429 may provide a seal to prevent sand or particulate material from entering the annulus between screen joints 420 and base pipes 403 at sealing elements 429 where communication sleeve 422 covers adaptors 424 and 426. Sealing elements 429 may be O-rings, metal-metal seals, or any other suitable connection that may provide a seal to prevent sand or particulate material from entering fluid flow path 432 at sealing elements 429.

Screen joints 420 and/or communication sleeve 422 may be formed of a mesh screen. The mesh screen may be a tube of a screen material. The screen may be formed of wire-wrap screen, premium screen, or any other suitable screen material. The wire-wrap screen may include corrosion-resistant wire wrapped around base pipe 403. The premium screen may include a woven metal cloth wrapped around base pipe 403. In some embodiments, screen joints 420 and/or communication sleeve 422 may be formed of a slotted liner. A slotted liner may be a tube with fixed size channels machined in the sides of the tube. The channels may be machined in a longitudinal direction along the length of screen joints 420 and/or communication sleeve 422 or may be machined in a latitudinal direction around the circumference of screen joints 420 and/or communication sleeve 422. Mesh screen and slotted liner may perform the same function of preventing sand or particulate material from wellbore 414 from entering base pipe 403.

In some embodiments, the gauge of the mesh screen or the size of the slots in the slotted liner used to form screen joints 420 and/or communication sleeve 422 may be the same across screen joints 420 and communication sleeve 422. In other embodiments, the gauge of the mesh screen or the size of the slots in the slotted liner used to form screen joints 420 may be different from the gauge of the mesh screen or the size of the slots in the slotted liner used to form communication sleeve 422. The mesh gauge of the screen material and/or the size of the slots in the slotted liner may be designed based on the size of the particles in wellbore 414, the strength and durability requirements of the environment in wellbore 414, and/or any other suitable design characteristic.

Figure 5:
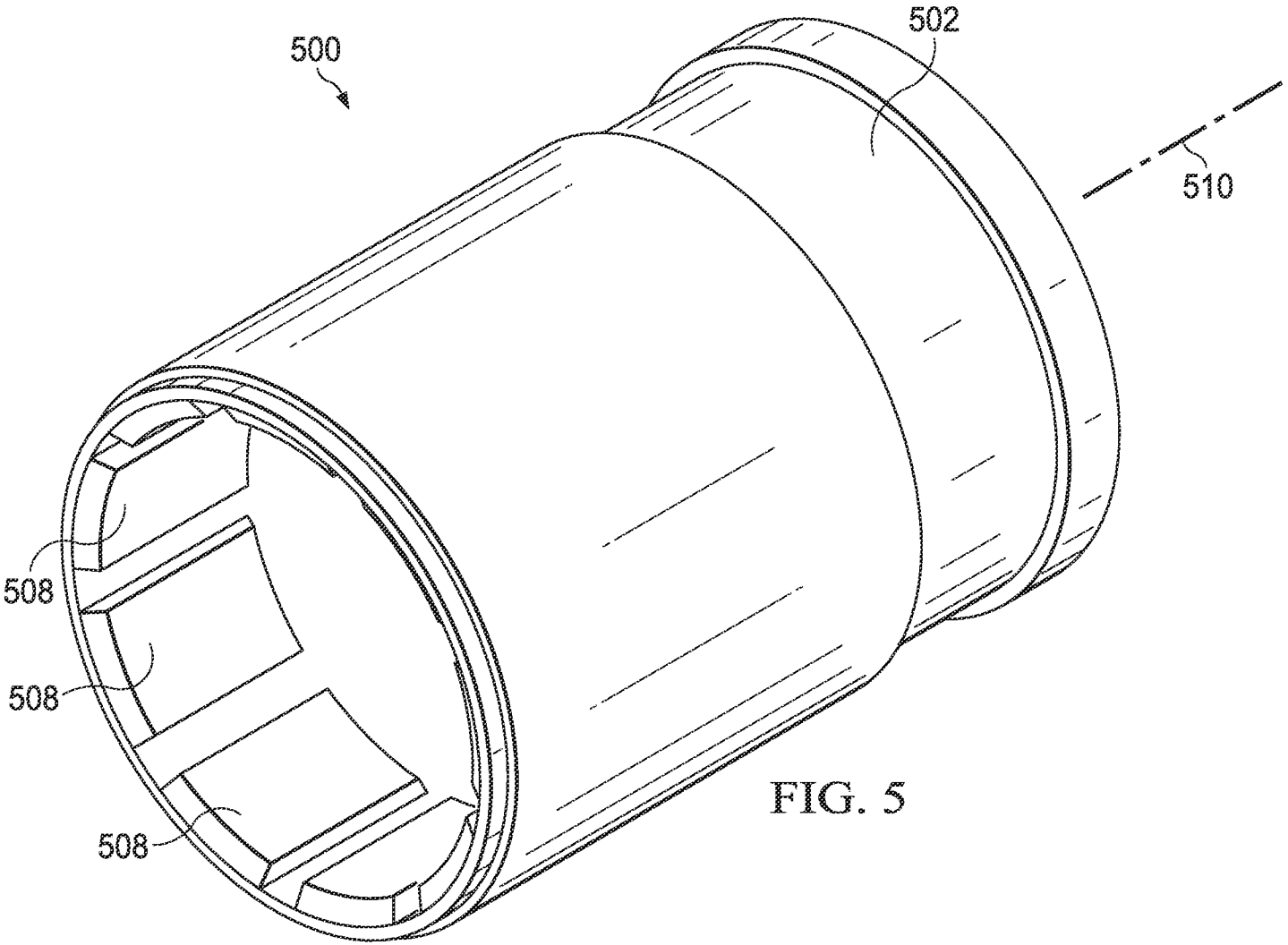
FIG. 5 illustrates a perspective view of a torque transmission tool.

When coupling base pipe 403*a* to base pipe 403*b*, a torque transmission tool may be used to prevent damage to screen joints 420 surrounding base pipe 403*a* and 403*b* during the mating process. FIG. 5 illustrates a perspective view of a torque transmission tool. Torque transmission tool 500 may be a cylindrical tool and may be made of any suitable material having sufficient strength, including stainless steel and high strength alloys. Torque transmission tool 500 may include shoulder 502, which is an indention in the outer surface of torque transmission tool 500 that may reduce the weight of torque transmission tool 500 and allow for easier handling. The depth of the indentation of shoulder 502 may be any suitable depth that reduces the weight of torque transmission tool 500 without compromising the strength of torque transmission tool 500. A clamp of a power tong may be engaged with the outer surface of torque transmission tool 500 to allow the power tong to be placed around torque transmission tool 500, as described in further detail in the discussion of FIGS. 6A-6D. The power tong engages with the outer surface of torque transmission tool 500 to grip torque transmission tool 500 and rotate torque transmission tool 500 around axis 510. The use of torque transmission tool 500 provides an area for the power tongs to engage with the production tubing including a base pipe and a screen joint without the power tongs directly gripping the screen joint, thus preventing damage to the screen joint.

Torque transmission tool 500 may further include teeth 508 which may be spaced to engage with centralizer fins on a box adaptor or a pin adaptor. Torque transmission tool 500 may slide over an adaptor and teeth 508 may fit in the spaces between each centralizer fin such that when torque transmission tool 500 is rotated around axis 510, the adaptor also rotates.

Figure 6A:
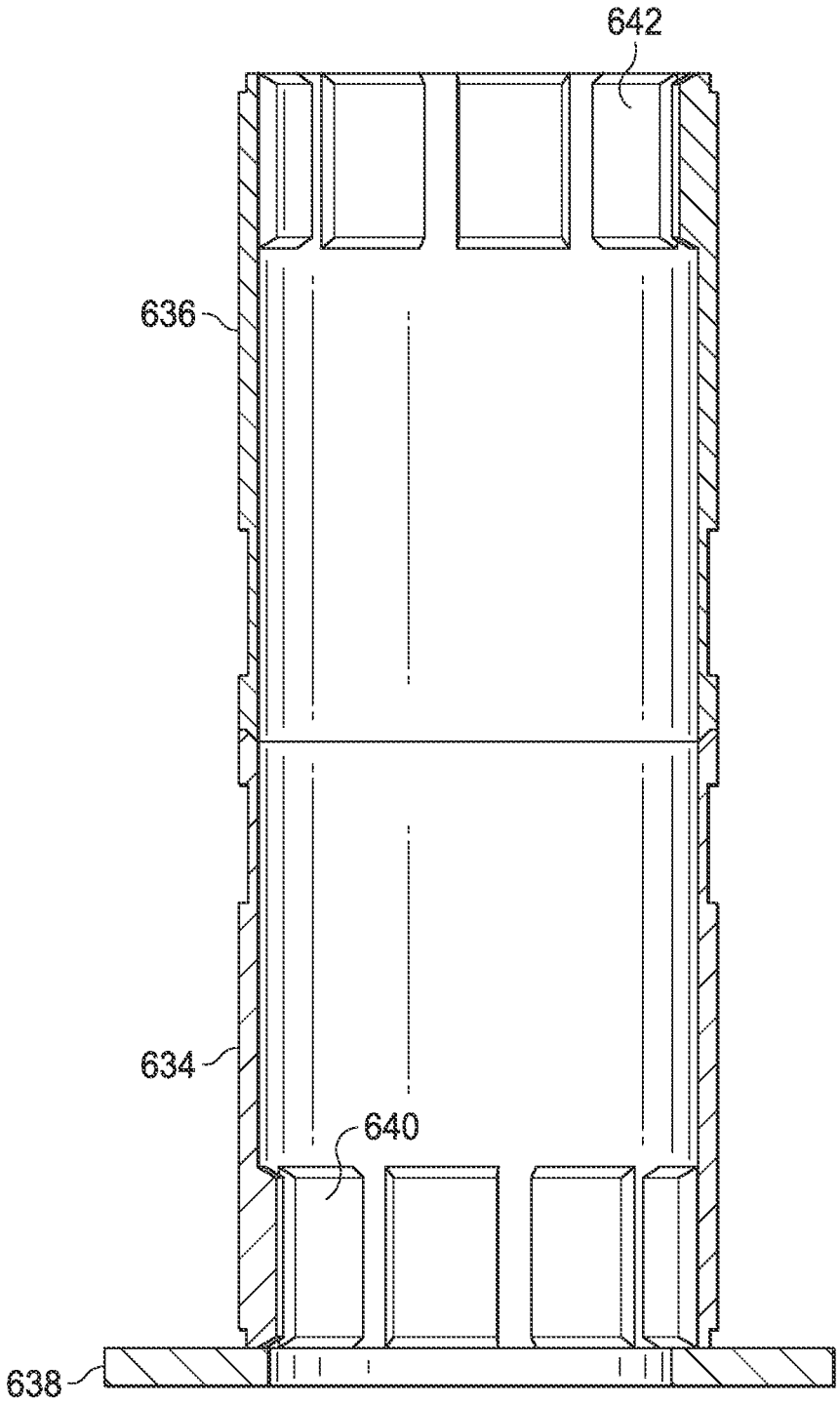
FIGS. 6A-6D illustrate cross-sectional views of different stages of the mating process used to couple sections of a double wall pipe system using a box adaptor and a pin adaptor.

FIGS. 6A-6D illustrate cross-sectional views of different stages of the mating process used to couple sections of a double wall pipe system using a box adaptor and a pin adaptor. FIG. 6A illustrates a cross-sectional view of two torque transmission tools resting on a screen table. Torque transmission tool 634 may be placed directly on screen table 638 in an orientation where the end of torque transmission tool 634 including teeth 640 is in contact with screen table 638. Torque transmission tool 636 may be placed on top of torque transmission tool 634 and vertically aligned with torque transmission tool 634 in an orientation where the end of torque transmission tool 636 including teeth 642 is placed away from torque transmission tool 634. Screen table 638 may be located at the well surface above a wellbore such that components passing through the central opening of screen table 638 may be lowered into the wellbore. Torque transmission tools 634 and 636 may be located at the well site above the wellbore.

Figure 6B:
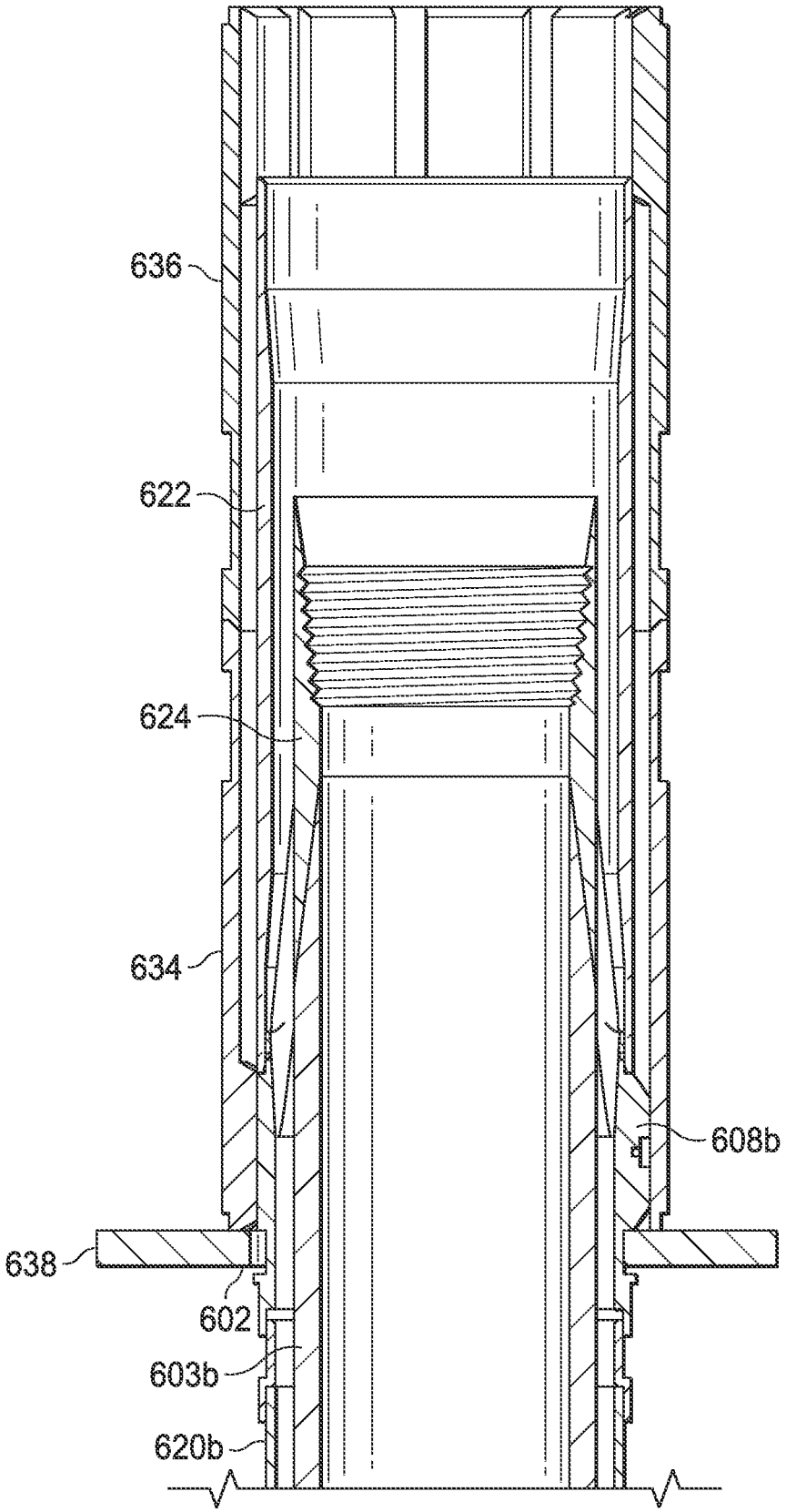

After torque transmission tools 634 and 636 are installed on the screen table, a first double wall pipe and a box adaptor may be lowered through the center of torque transmission tools 634 and 636. FIG. 6B illustrates a cross-sectional view of a first double wall pipe and a box adaptor lowered through two torque transmission tools. Base pipe 603*b* and screen joint 620 may be coupled together to form a double wall pipe and box adaptor 624 may be coupled to one axial end of the double wall pipe. Base pipe 603*b*, screen joint 620*b*, and box adaptor 624 may be lowered through the centers of torque transmission tool 636 and torque transmission tool 634 until screen table shoulder 602 on box adaptor 624 is engaged with screen table 638.

Once screen table shoulder 602 is engaged with screen table 638, the position of torque transmission tool 634 may be adjusted such that teeth 640 (shown in FIG. 6A) are engaged with box adaptor 624 in the spaces between centralizer fins 608*b*. Teeth 640 are obscured by box adaptor 624 in FIG. 6B. The engagement of teeth 640 with centralizer fins 608*b* may allow power tongs to grip torque transmission tool 634 and rotate box adaptor 624 during the mating process, as described in further detail with respect to FIG. 6C.

In some examples, communication sleeve 622 may be attached to box adaptor 624 during the manufacturing process prior to the mating process shown in FIGS. 6A-6D.

Figure 6C:
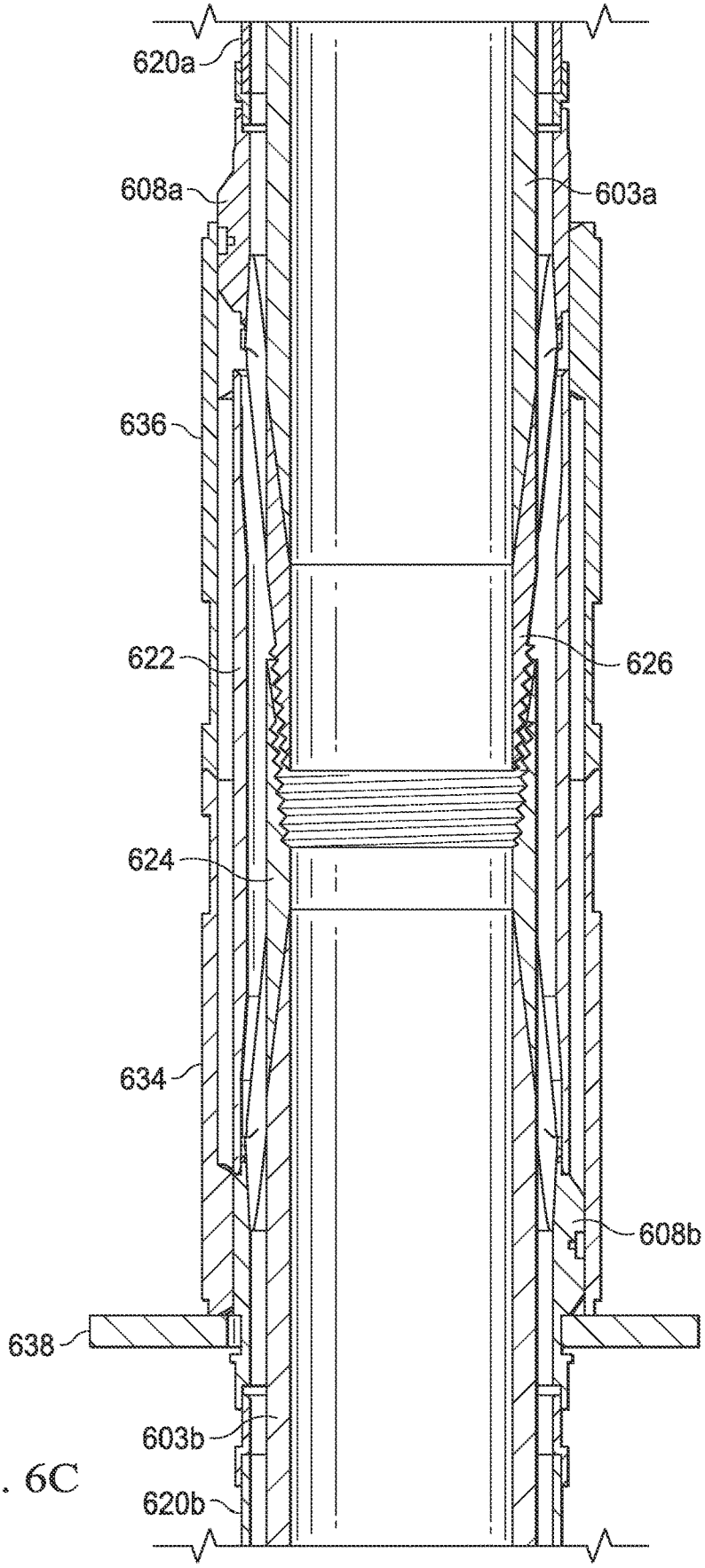

Communication sleeve 622 may be attached to cover the tapered portion of box adaptor 624 with one end open to receive the tapered portion of pin adaptor 626 (not expressly shown in FIG. 6B), as shown in FIG. 6C. In other examples, communication sleeve 622 may be slid onto box adaptor 624 during the mating process before pin adaptor 626 is coupled to box adaptor 624.

After box adaptor 624 is engaged with screen table 638, a second double wall pipe and a pin adaptor coupled to the second double wall pipe may be lowered through the center of torque transmission tool 636 such that box adaptor 624 and the pin adaptor may be coupled together. FIG. 6C illustrates a cross-sectional view of a second double wall pipe and a pin adaptor lowered through a torque transmission tool. Base pipe 603*a* and screen joint 620*a* may be coupled together to form a double wall pipe and coupled to pin adaptor 626. Base pipe 603*a*, screen joint 620*a*, and pin adaptor 626 may be lowered through torque transmission tool 636 until teeth 642 engage with centralizer fins 608*a*. The tapered end of pin adaptor 626 may be partially inserted into box adaptor 624 at this point in the mating process or may be resting on box adaptor 624.

Once box adaptor 624 is engaged with torque transmission tool 634 and pin adaptor 626 is engaged with torque transmission tool 636, power tongs may be placed over torque transmission tools 634 and 636. The power tongs may grip and rotate torque transmission tools 634 and 636 to complete the mating process. For example, one power tong may grip torque transmission tool 634 and rotate torque transmission tool 634 and box adaptor 624 in a clockwise direction while another power tong may grip torque transmission tool 636 and rotate torque transmission tool 636 and pin adaptor 626 in a counter-clockwise direction. The counter rotation of box adaptor 624 and pin adaptor 626 allows the threads on pin adaptor 626 to be screwed into the threads on box adaptor 624. While in the example box adaptor 624 rotates clockwise and pin adaptor 626 rotates counter-clockwise, the directions may be reversed.

Figure 6D:
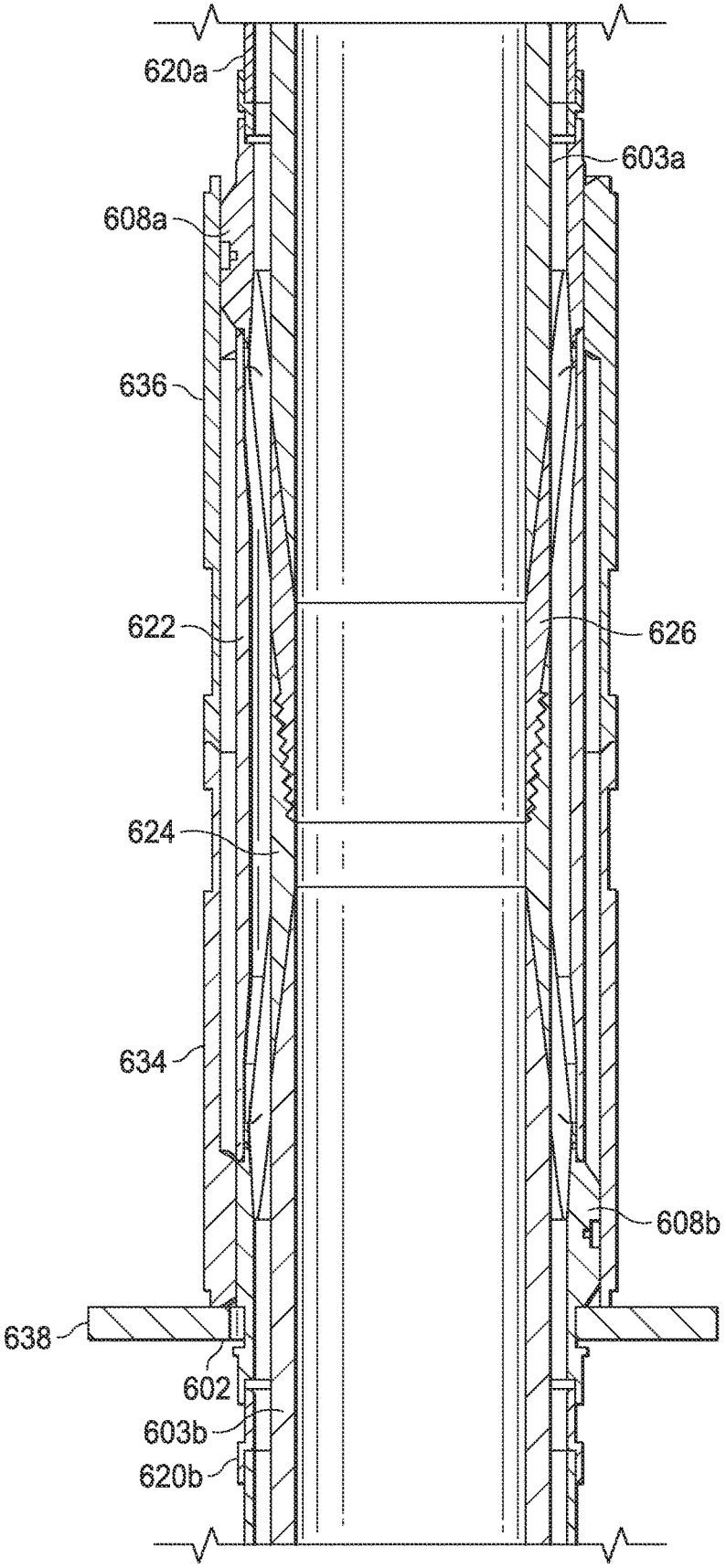

After box adaptor 624 and pin adaptor 626 have been coupled together, box adaptor 624 and pin adaptor 626 form a junction between the first and second double wall pipe sections. FIG. 6D illustrates a cross-sectional view of a double-wall pipe connection system after the box adaptor and the pin adaptor have been mated together. After the power tongs have coupled box adaptor 624 to pin adaptor 626, the power tongs may be removed from around torque transmission tools 634 and 636. Screen table 638 may be removed from screen table shoulder 602 to allow box adaptor 624 and pin adaptor 626 to pass through torque transmission tools 634 and 636 and into the wellbore.

Once the mating of box adaptor 624 and 626 is complete, a control line (not expressly shown) may be routed across the junction between box adaptor 624 and pin adaptor 626. By routing the control line after the mating process, the control line may be routed across the junction by the most direct path.

The process described in FIGS. 6A-6D may be repeated for each junction between two base pipes. The use of torque transmission tools 634 and 636 allow box adaptor 624 and pin adaptor 626 to be mated without damaging communication sleeve 622, as the force of the power tongs is applied to torque transmission tools 634 and 636 and not to communication sleeve 622.

Additionally, the unscreened space between screen joints 620 and communication sleeve 622 may be minimized as the only unscreened space is the surface of box adaptor 624 and pin adaptor 626 including centralizer fins 608 due to the use of torque transmission tools 634 and 636. Communication sleeve 622 may maximize the screen coverage in the double walled pipe system and provide virtually uninterrupted screen coverage in a production zone of the wellbore. For example, communication sleeve 622 may allow fluids to enter base pipes 603 along the length of communication sleeve 622. If a larger portion of box adaptor 624 and/or pin adaptor 626 were left unscreened, fluid may be diverted to screen joint 620*a* or 620*b*. When fluid is diverted to screen joints 620, a high pressure point may be created on each side of the screened portions of the double walled pipe system due to a high rate of fluid flow in a localized area. A high pressure point may cause damage to screen joints 620 and/or communication sleeve 622.

Embodiments disclosed herein include:

A. A double wall pipe connection system including a box adaptor having a first end and a second end, the first end coupled to a first base pipe and a first screen joint; a pin adaptor having a first end and a second end, the first end coupled to a second base pipe and a second screen joint and the second end of the box adaptor coupled to the second end of the pin adaptor to form a junction between the box adaptor and the pin adaptor; and a communication sleeve positioned across the junction between the box adaptor and the pin adaptor.

B. A method of installing a double wall pipe connection system in a wellbore including positioning a first torque transmission tool and a second torque transmission tool on a screen table such that the first and second torque transmission tools are vertically aligned on the screen table; lowering a first production tubing section through the first and second torque transmission tools. The first production tubing section including a first base pipe; a first screen joint surrounding the first base pipe; and a box adaptor having a first end and a second end where the first end is coupled to the first base pipe. The method additionally includes engaging the box adaptor with the first screen tool; lowering a second production tubing section through the second torque transmission tool. The second production tubing section including a second base pipe; a second screen joint surrounding the second base pipe; and a pin adaptor having a first end and a second end, the first end coupled to the second base pipe. The method further includes engaging the second production tubing section with the second torque transmission tool; coupling the second end of the box adaptor and the second end of the pin adaptor; disengaging the first and second production tubing sections from the first and second torque transmission tools; and lowering the first and second production tubing sections into a wellbore.

C. A subterranean operations system including a first base pipe; a first screen joint surrounding the first base pipe to create a first double wall pipe; a second base pipe; a second screen joint surrounding the second base pipe to create a second double wall pipe; and a double wall pipe connection system coupling the first double wall pipe and the second double wall pipe. The double wall pipe connection system including a box adaptor having a first end and a second end, the first end coupled to the first double wall pipe; a pin adaptor having a first end and a second end, the first end coupled to the second double wall pipe and the second end of the box adaptor coupled to the second end of the pin adaptor to form a junction between the box adaptor and the pin adaptor; and a communication sleeve positioned across the junction between the box adaptor and the pin adaptor.

Each of embodiments A, B, and C may have one or more of the following additional elements in any combination: Element 1: wherein at least one of the box adaptor and the pin adaptor further include a plurality of centralizer fins. Element 2: wherein at least one of the plurality of centralizer fins include a threaded hole and a plastic cap inserted into the threaded hole. Element 3: wherein the communication sleeve is formed of at least one of a mesh screen, a wire-wrap screen, and a slotted liner. Element 4: wherein the box adaptor includes a first fluid flow port; and the pin adaptor includes a second fluid flow port. Element 5: wherein at least one of the box adaptor and the pin adaptor include a screen table shoulder. Element 6: wherein the pin adaptor includes a threading on an outer surface; the box adaptor includes a threading on an inner surface; and the threading on the pin adaptor engages with the threading on the box adaptor to couple the components together.

Although the present disclosure and its advantages have been described in detail, it should be understood that various changes, substitutions and alterations can be made herein without departing from the spirit and scope of the disclosure as defined by the following claims. For example, while the embodiment discussed describes a box adaptor including a screen table shoulder and being located downhole from a pin adaptor, the pin adaptor may include a screen table shoulder and be located downhole from the box adaptor.

What is claimed is:

1. A double wall pipe connection system comprising:

a box adaptor having a first end and a second end, the first end of the box adaptor coupled to a first base pipe and a first screen joint;

a pin adaptor having a first end and a second end, the first end of the pin adaptor coupled to a second base pipe and a second screen joint and the second end of the box adaptor directly coupled to the second end of the pin adaptor to form a junction between the box adaptor and the pin adaptor; and a communication sleeve positioned across the junction between the box adaptor and the pin adaptor.

2. The double wall pipe connection system of claim 1, wherein at least one of the box adaptor and the pin adaptor further include a plurality of centralizer fins.

3. The double wall pipe connection system of claim 2, wherein at least one of the plurality of centralizer fins include a threaded hole and a plastic cap inserted into the threaded hole.

4. The double wall pipe connection system of claim 1, wherein the communication sleeve is formed of at least one of a mesh screen, a wire-wrap screen, and a slotted liner.

5. The double wall pipe connection system of claim 1, wherein the box adaptor includes a first fluid flow port; and the pin adaptor includes a second fluid flow port.

6. The double wall pipe connection system of claim 1, wherein at least one of the box adaptor and the pin adaptor include a screen table shoulder.

7. The double wall pipe connection system of claim 1, wherein the pin adaptor includes a threading on an outer surface;

the box adaptor includes a threading on an inner surface; and the threading on the pin adaptor engages with the threading on the box adaptor to couple the components together.

8. A method of installing a double wall pipe connection system in a wellbore comprising:

positioning a first torque transmission tool and a second torque transmission tool on a screen table such that the first and second torque transmission tools are vertically aligned on the screen table;

lowering a first production tubing section through the first and second torque transmission tools, the first production tubing section including:

a first base pipe;

a first screen joint surrounding the first base pipe; and a box adaptor having a first end and a second end, the first end of the box adaptor coupled to the first base pipe;

engaging the box adaptor with the first torque transmission tool;

lowering a second production tubing section through the second torque transmission tool, the second production tubing section including:

a second base pipe;

a second screen joint surrounding the second base pipe; and a pin adaptor having a first end and a second end, the first end of the pin adaptor coupled to the second base pipe;

engaging the second production tubing section with the second torque transmission tool;

coupling the second end of the box adaptor and the second end of the pin adaptor;

disengaging the first and second production tubing sections from the first and second torque transmission tools; and lowering the first and second production tubing sections into a wellbore.

9. The method of claim 8, wherein at least one of the box adaptor and the pin adaptor further include a plurality of centralizer fins.

10. The method of claim 9, wherein at least one of the plurality of centralizer fins include a threaded hole and a plastic cap inserted into the threaded hole.

11. The method of claim 8, wherein at least one of the first or the second screen joints is formed of at least one of a mesh screen, a wire-wrap screen, and a slotted liner.

12. The method of claim 8, wherein the box adaptor includes a first fluid flow port; and the pin adaptor includes a second fluid flow port.

13. The method of claim 8, wherein at least one of the box adaptor and the pin adaptor include a screen table shoulder.

14. The method of claim 8, wherein the pin adaptor includes threading on an outer surface;

the box adaptor includes threading on an inner surface; and the pin adaptor and the box adaptor are coupled together by engaging the threading on the outer surface of the pin adaptor with the threading on the inner surface of the box adaptor.

15. A subterranean operations system, comprising:

a first base pipe;

a first screen joint surrounding the first base pipe to create a first double wall pipe;

a second base pipe;

a second screen joint surrounding the second base pipe to create a second double wall pipe; and a double wall pipe connection system coupling the first double wall pipe and the second double wall pipe, the double wall pipe connection system including:

a box adaptor having a first end and a second end, the first end of the box adaptor coupled to the first double wall pipe;

a pin adaptor having a first end and a second end, the first end of the pin adaptor coupled to the second double wall pipe and the second end of the box adaptor directly coupled to the second end of the pin adaptor to form a junction between the box adaptor and the pin adaptor; and a communication sleeve positioned across the junction between the box adaptor and the pin adaptor.

16. The subterranean operations system of claim 15, wherein at least one of the box adaptor and the pin adaptor further include a plurality of centralizer fins.

17. The subterranean operations system of claim 16, wherein at least one of the plurality of centralizer fins include a threaded hole and a plastic cap inserted into the threaded hole.

18. The subterranean operations system of claim 15, wherein the box adaptor includes a first fluid flow port; and the pin adaptor includes a second fluid flow port.

19. The subterranean operations system of claim 15, wherein at least one of the box adaptor and the pin adaptor include a screen table shoulder.

20. The subterranean operations system of claim 15, wherein the pin adaptor includes threading on an outer surface;

the box adaptor includes threading on an inner surface; and the pin adaptor and the box adaptor are coupled together by engaging the threading on the outer surface of the pin adaptor with the threading on the inner surface of the box adaptor.

* * * * *